US007143803B2

(12) United States Patent
Mitchell

(10) Patent No.: US 7,143,803 B2
(45) Date of Patent: Dec. 5, 2006

(54) AUTOMATIC AND A MANUAL LIFT-UP VENTILATED GATE FOR USE WITH AN OVERHEAD GARAGE DOOR

(76) Inventor: James E. Mitchell, 7616 Dunleer Way, Dallas, TX (US) 75248

( * ) Notice: Subject to any disclaimer, the term of this patent is extended or adjusted under 35 U.S.C. 154(b) by 265 days.

(21) Appl. No.: 10/814,742

(22) Filed: Apr. 1, 2004

(65) Prior Publication Data

US 2005/0217803 A1 Oct. 6, 2005

(51) Int. Cl.
*E06B 3/48* (2006.01)

(52) U.S. Cl. ..... 160/113; 160/96; 160/97; 49/131; 49/145

(58) Field of Classification Search ..... 160/113, 160/201, 188, 189, 95, 96, 97, 104; 49/197, 49/199, 131, 104, 115, 143, 145
See application file for complete search history.

(56) References Cited

U.S. PATENT DOCUMENTS

| | | | | | |
|---|---|---|---|---|---|
| 1,944,349 | A | * | 1/1934 | Kincaid | 49/131 |
| 2,200,727 | A | * | 5/1940 | Swenson | 49/73.1 |
| 3,024,549 | A | * | 3/1962 | Lubmann | 49/131 |
| 3,775,912 | A | * | 12/1973 | Walls | 49/131 |
| 4,231,412 | A | | 11/1980 | Nowak | |
| 4,378,043 | A | * | 3/1983 | Sorenson | 160/97 |
| 4,574,860 | A | | 3/1986 | Weiss | |
| 4,653,566 | A | | 3/1987 | Miale | |
| 4,770,087 | A | | 9/1988 | Danley et al. | |
| D338,966 | S | | 8/1993 | Pinard | |
| D341,429 | S | | 11/1993 | Welch | |
| 5,323,835 | A | | 6/1994 | Bachmeier | |
| 5,358,025 | A | | 10/1994 | Wood | |
| 5,408,789 | A | * | 4/1995 | Plfeger | 52/173.2 |
| 5,427,169 | A | | 6/1995 | Saulters | |
| D375,365 | S | | 11/1996 | Kinkade et al. | |
| 5,611,382 | A | * | 3/1997 | Sferra | 160/113 |
| 5,846,127 | A | | 12/1998 | Kile | |
| 5,848,630 | A | * | 12/1998 | Manzo | 160/113 |
| 5,860,465 | A | * | 1/1999 | Eastridge et al. | 160/113 |
| 5,899,254 | A | | 5/1999 | Cook | |
| 5,904,199 | A | * | 5/1999 | Messner | 160/219 |
| 5,976,009 | A | | 11/1999 | Achen | |
| 6,003,583 | A | | 12/1999 | Lacoste et al. | |
| 6,053,235 | A | | 4/2000 | Ruffner | |
| 6,092,580 | A | * | 7/2000 | Lucas | 160/113 |
| 6,557,614 | B1 | * | 5/2003 | Lampers | 160/113 |

* cited by examiner

*Primary Examiner*—David Purol
(74) *Attorney, Agent, or Firm*—F. Lindsey Scott

(57) ABSTRACT

An ventilated gate for use with an overhead garage door. The ventilated gate is an added feature to a conventional overhead garage door and provides ventilation to a garage where such ventilation is unavailable through a conventional overhead garage door. The ventilated gate is in a flat position on a driveway in front of the garage door when not in use and in a raised position between the driveway and the bottom of the garage door when in use.

13 Claims, 4 Drawing Sheets

AUTOMATIC AND A MANUAL LIFT-UP VENTILATED GATE FOR USE WITH AN OVERHEAD GARAGE DOOR

FIELD OF THE INVENTION

This invention relates to an automated ventilated gate for use with a garage door wherein the automated ventilated gate is an added feature to a conventional overhead garage door and is in a flat position on a driveway in front of the garage door when the garage door is open and is in a raised position between the driveway and the bottom of the garage door when the garage door is closed. The automated ventilated gate provides ventilation to a garage that is unavailable through a conventional overhead garage door. The invention further comprises a manual ventilated gate, which is manually raisable from a flat position in front of the garage door.

BACKGROUND OF THE INVENTION

In many instances, it is desirable to ventilate a garage space that is enclosed by the use of a conventional overhead garage door. Such garage doors typically comprise a plurality of hingedly joined sections with each of the sections having a first and a second end and being supported at their ends in a garage door support and moveable between open and closed positions. Typically, the garage door is opened and closed by movement in the garage door support by a garage door opener, which may be of various well-known types. The garage door may also be opened and closed manually.

Typically, attempts to ventilate a garage space have comprised the partial closure of the garage door. This not only leaves a space beneath the door open for the entrance of mice and other vermin but also leaves the door partially open in the event vandals or criminals seek to enter the garage. Frequently the garage space provides ready access to the house via a door which may have been left unlocked or which can easily be opened by a criminal in a space that is relatively hidden from the view of passersby.

While the presence of a ventilated section in a lower or other portion of a garage door is beneficial in ventilating garage space during hot weather, it is detrimental in ventilating the garage space in cold or inclement weather. Accordingly continued efforts have been directed to the development of a ventilated gate that can be automatically or manually raised into engagement with a garage door only when desired.

SUMMARY OF THE INVENTION

The present invention provides a lift-up, ventilated gate for use with a garage door comprising a plurality of hingedly joined sections, each of the sections having a first and a second end and being supported in a garage door support at their first and second ends for movement in the garage door support to move the garage door between an open and a closed position, the garage door being moveable in the garage door support between an open and a closed position, the ventilated gate having a top and a bottom, a frame, a ventilation section in the frame, an inside and an outside, a first end and a second end and being hingedly connectable to a driveway surface across a major portion of a width of the garage door opening and having a cable connection near the top of the ventilated gate on each of its first and second ends adapted for connection to a cable to enable the cable to pull the ventilated gate from a flat position on the driveway surface to an upright position so that the top of the ventilated gate engages a bottom of the garage door when the garage door is partially closed.

The present invention further provides an automatic lift-up, ventilated gate and a system for opening and closing the ventilated gate for use with a garage door comprising a plurality of hingedly joined sections, each of the sections having a first and a second end and being supported in a garage door support at their first and second ends for movement in the garage door support to move the garage door between an open and a closed position, the system comprising: a ventilated gate having a top and a bottom, a frame, a ventilation section in the frame, an inside and an outside, a first end and a second end, being hingedly connectable to a driveway surface across a major portion of a width of the garage door and having a cable connection near the top of the ventilated gate on each of its first and second ends; and, a first and a second cable and pulley system adapted for support on at least one of the garage door supports and garage surfaces connected near the top of the ventilated gate to the first and second ends of the ventilated gate respectively and to a first and a second side respectively of a top of the garage door so that when the garage door is lowered toward its closed position the cable and pulley systems raise the ventilated gate to an upright position so that the top of the ventilated gate engages a bottom of the garage door.

The invention further comprises a ventilated gate for use with an overhead garage door comprising a plurality of hingedly joined sections, each of the sections having a first and a second end and being supported in a garage door support at their first and second ends for movement in the garage door support to move the garage door between an open and a closed position, the ventilated gate having a top and a bottom, a frame, a ventilation section in the frame, an inside and an outside, a first and a second end and being hingedly connectable to a driveway surface across a major portion of a width of the garage door opening and being manually raisable to an upright position so that the top of the ventilated gate is positioned for engagement with a bottom of the garage door when the garage door is in a partially closed position.

DESCRIPTION OF PREFERRED EMBODIMENTS

In the discussion of the Figures, the same numbers will be used to refer to the same or similar components throughout in the description of all of the Figures. Various features of a garage door construction have not been shown unless necessary for description of the present invention.

Figure 1:
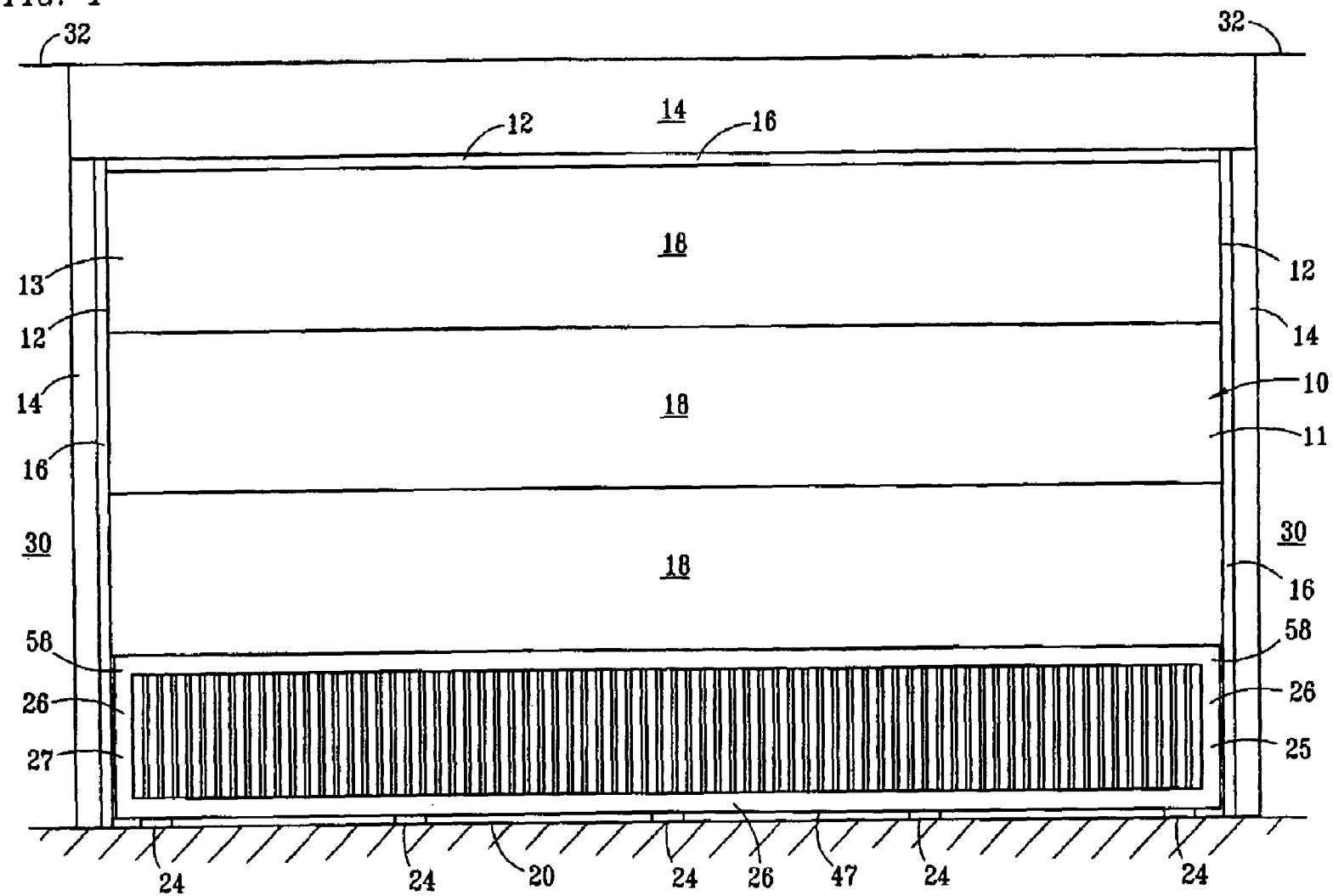
FIG. 1 is an exterior view of a garage door having a lift-up, ventilated gate according to the present invention in a lifted position and in engagement with the bottom of a garage door for ventilating a garage space.

In FIG. 1 a garage door 10 is shown in a frame 12. Garage door 10 has a first end 11 and a second end 13 and comprises hingedly connected sections 18. Frame 12 comprises an outer member 14 which is typically a relatively heavy support member such as a 2"×12" wooden member and an inner member 16, which is typically a 1"×3" or 1"×4" wooden member positioned so that the garage door when in a lowered position is restrained from outward movement relative to outer member 14 by inner member 16. A top 17 of garage door 10 is typically restrained by inner member 16 at the top of frame 12. In the present invention, the top of the garage door may not be in engagement with the frame at the top of the garage door when the garage door is in a partially closed position with a ventilated gate in its upright position beneath the garage door.

Typically the driveway in front of the garage door is a cement slab 20. A ventilated gate 22 is positioned so that it is supported by hinges 24 from cement slab 20 so that it may be raised from a flat position on cement slab 20 when the garage door is open to a raised position as shown in FIG. 1 when the garage door is partially closed. The ventilated gate comprises an outer frame 26 having a top 46 and a bottom 47. At least two hinges 24 or an elongated single hinge is positioned to hingedly connect bottom 47 of ventilated gate 22 to cement slab 20. These hinges are positioned so that gate 22, when in its lowered flat position, as shown in more detail in FIG. 8, lies flat against cement slab 20. Hinges 24 are fastened to cement slab 20 as shown and to ventilated gate 22 as shown so that when ventilated gate 22 is raised it is supported by hinges 24 beneath a bottom 38 of the garage door. Typically, outer member 14 at the top of the doorframe is wider than the side members in its exposed exterior cross section of the door and may extend upwardly to the top of wall 32 in which the door is placed.

The door comprises sections 18 which are supported at their first ends 11 and second ends 13, which coincide with first edge 11 and second edge 13 of the garage door, in a garage door support 82 for movement upwardly and downwardly in garage door support 82, as well known to those skilled in the art.

Typically garage exterior 30 surrounding frame 12 may comprise brick, clapboard or other construction materials as known to those in the art.

As shown in FIG. 1, the ventilated gate includes a plurality of slats 28 positioned in outer frame 26, which comprises a top portion 46 and a bottom portion 47 of the frame. The ends of the frame are formed by frame portions at first end 25 and at second end 27 of the ventilated gate. The slats are positioned in the frame by any suitable means and may comprise any suitable material. The frame, including the slats, must be sufficiently strong so that it is stable in position beneath the garage door and so that it can be driven over by vehicles and the like without damage when in its flat position on the cement slab. One of the requirements for the frame is that it be positioned flat on the cement slab in its resting position so that it does not have to support the weight of a vehicle above an open space beneath the ventilated gate. The gate could alternatively be positioned over an opening if constructed to have a suitable strength. Alternatively, the gate could be installed to rest on the floor inside the garage if desired. The frame encloses a ventilation zone 23 defined by the frame and containing slats across its width, i.e., between the top frame member and the bottom frame member. The slats and frame may be of any suitable material such as wood, metal, plastic, combinations thereof and the like.

Figure 2:
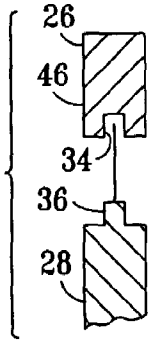
FIG. 2 is a schematic diagram of an embodiment of an assembly technique for the fabrication of the ventilated gate.

In FIG. 2, one suitable method of fabricating the ventilated gate is shown. In this figure an outer frame portion 26, i.e., a top portion 46 of frame 26 is shown and includes a frame groove 34 adapted to receive a tab 36 on a slat 28. The slat may contain a tab, which may be ¾" by ¾" or any other suitable dimension, which is formed to matingly engage slot 34 on upper portion 46 of frame 26. A slat and groove construction may be used or mating holes could be drilled to receive rounded tabs on the end of the slats or the like. A wide variety of fabrication techniques are acceptable. A preferred material for the construction of the ventilated gate is wood, metal, plastic, combinations thereof and the like. Other materials could be used provided they meet the requirements for strength and ventilation required in the fabrication of ventilated gate 22. Further a screen (not shown) could be placed over the ventilation zone, preferably on its exterior, or in or over the spaces between the slats to prevent the entry of mice and other vermin.

Figure 3:
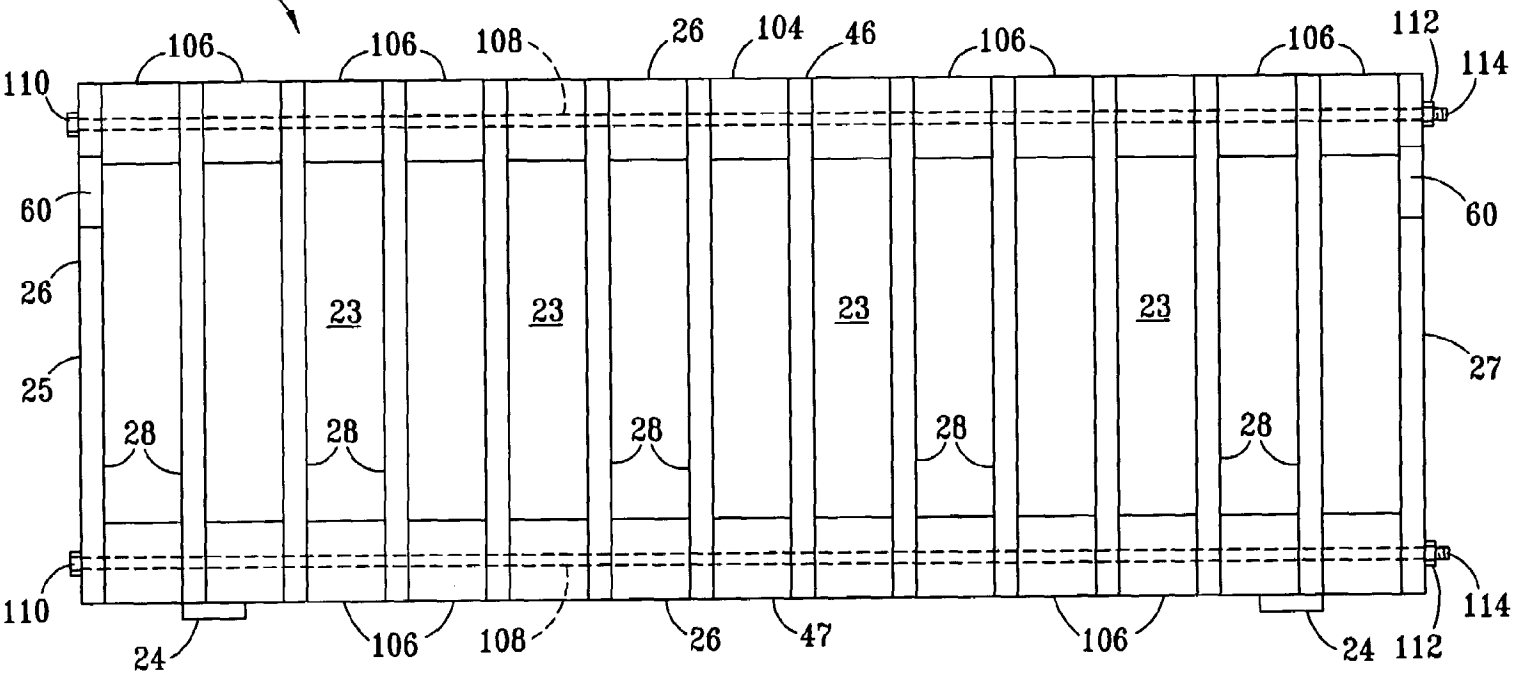
FIG. 3 is a view of a further embodiment of a ventilated gate.

In FIG. 3, a preferred construction of a ventilated gate is shown. In this construction, a plurality of slats 28 is positioned to form a ventilation passageway 23 between the slats. The slats are formed into a ventilation gate by positioning a block 106 between each pair of slats to form a top and a bottom frame, as shown.

The slats and blocks are maintained in position as shown in FIG. 3 by a pair of bolts 108 each having a head 110 and a nut 112. It will be appreciated that any bolt 108 may comprise a threaded rod with a nut at each end and the like. After the bolts have been tightened, any excess length 114 of the bolts on the outer ends beyond the nuts can be removed if desired. The slats and blocks can be readily retained in position in this fashion to form the top 46 and bottom 47 of frame 26. The ventilated gate comprises frame ends 25 and 26, which are slats forming the ends of the outer frame and of the ventilation gate. If desired, the outer slats could be made slightly thicker than the remaining slats and the like. The construction shown is a preferred embodiment of the construction of the ventilated gate. Many variations in the construction of the ventilating gate are possible and well within the skill of those in the art. Particularly, the slats and blocks may be glued together and retained in position until the glue is set. Other suitable restraining means could be used.

The ventilated gate can be raised manually from its flat position to an upright position by a handle (not shown) positioned generally on the inside of the ventilated gate at about its center 104 or at other locations if preferred. This handle may be of any convenient configuration such as a metal handle, a pull rope, a handle formed in a block or the like as known to those skilled in the art. By the use of this handle, the ventilated gate can be raised alone. When the ventilated gate is raised alone, it forms a ventilated gate over the lower portion of the garage door opening without the necessity to lower the garage door. The gate may also be configured, and preferably is configured, for automatic operation with cable connections on the upper portions of the inside of the gate at its first and second ends.

When the gate is set up for manual operation, ferromagnetic metal plates 60 are placed on each end of the ventilated gate so that these plates may engage magnetic elements positioned on each side of the garage door to hold the ventilated gate in an upright position.

While manual operation of the ventilated gate may be necessary or desirable in some instances, it also presents the disadvantage that the gate as raised is below normal eye level and may not be observed by people passing into and out of the garage in some instances. For this reason, the use of the manually raisable gate is not preferred. Nevertheless, it may be desirable in some instances to use a gate that can be manually raised or lowered so that the door can be lowered onto the gate and raised above the gate without disturbing the positioning of the gate.

In the discussion of the invention in this disclosure, the term "automatic" is used to refer to a ventilated gate, which is raised or lowered as a result of activation by movement of the garage door. The garage door may be moved either manually or with a garage door opener.

Figure 4:
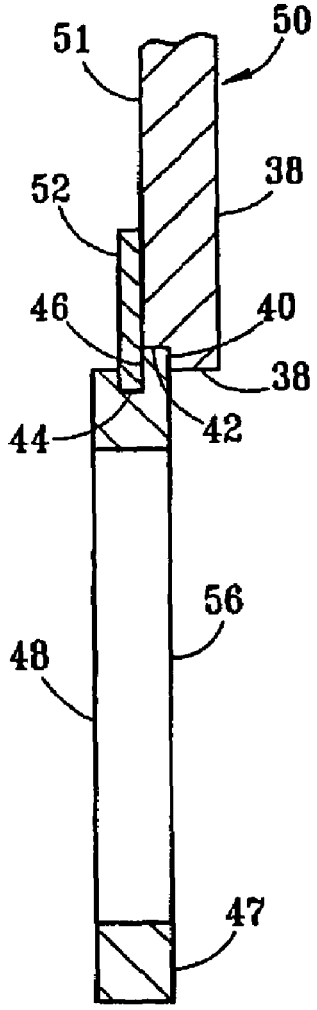
FIG. 4 is a schematic diagram of a pin and receptacle positioned in the bottom of the garage door and the top of the ventilated gate respectively.

In FIG. 4, a security arrangement is shown between ventilated gate 22 and the bottom 38 of the garage door. A notch 40 is formed on an inside 51 of the bottom of the garage door to matingly engage a lip 42 on the top of ventilated gate 22. This lip and notch can be arranged for mating engagement when the gate and door are not perfectly aligned (as shown) or when the gate and the door are more completely aligned. This prevents movement of the garage door inwardly over the top of the inside 48 of ventilated gate 22. While not shown, the positioning of the lip and notch could be reversed to put the lip on the bottom of the garage door and the notch on the ventilated gate. Any suitable mating configuration can be used. As a further security measure, an opening 44 is positioned in top 46 of the frame. A pin 52 is mounted on the inside of the garage door for mating engagement with the opening or receptacle 44 in or near top 46 of the frame. This prevents movement of either the garage door or the ventilated gate past each other as a result of force exerted on either the outside 50 or the inside 51 of the garage door or the inside 48 or outside 56 of the ventilated gate.

The pin, as indicated, may be mounted on the inside of the garage door for mating engagement with an opening in the top of the frame. The pin is desirably positioned to extend beneath the bottom of the garage door for mating engagement with a receptacle in or near the top of the frame. Similarly, the pin may be positioned on the ventilated gate to extend beyond the top of the ventilated gate to engage a receptacle positioned near the bottom of the garage door. The receptacle may be a hole in the bottom of the garage door or it may be a bracket connected to the inside of the garage door or the like. Any suitable arrangement of pins and receptacles is suitable so long as it effectively prevents movement of either the garage door or the ventilated gate passed each other.

Figure 5:
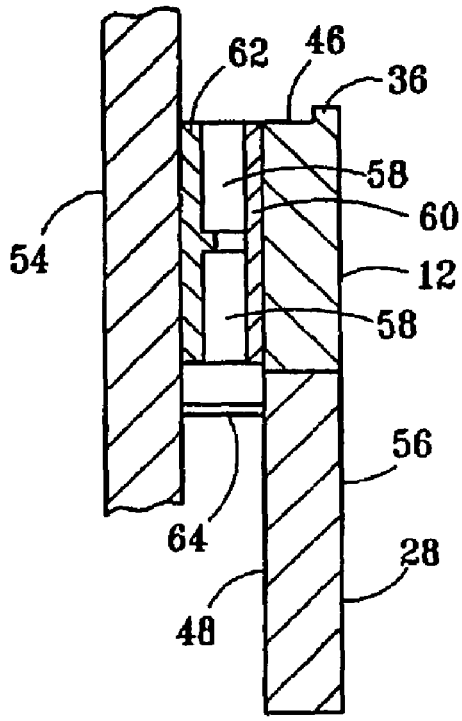
FIG. 5 is a schematic diagram of a magnetic retaining system for retaining the top of a manual ventilated gate in position.

To maintain ventilated gate 22 in its upright position when the gate is manually raisable and lowerable, a magnetic retaining system comprising at least one magnet 58, (two are shown) is positioned on a garage wall 54, which directly or indirectly supports the magnets, as shown in FIG. 5. The magnets can be supported from the garage door support or from a garage wall surface as desired. The magnets are positioned to engage a ferromagnetic metal plate 60 on the inside of ventilated gate 22 when it is in a raised position as shown in FIG. 5. The magnets are typically positioned on a non-magnetic support 62.

In the embodiment shown in FIG. 5, a contact switch 64 is shown which is drawn into engagement with a surface of the automated ventilated gate when the ventilated gate is in its upright position. This switch is effective to select one of at least two positions available on the garage door opener for positioning a garage door.

Figure 6:
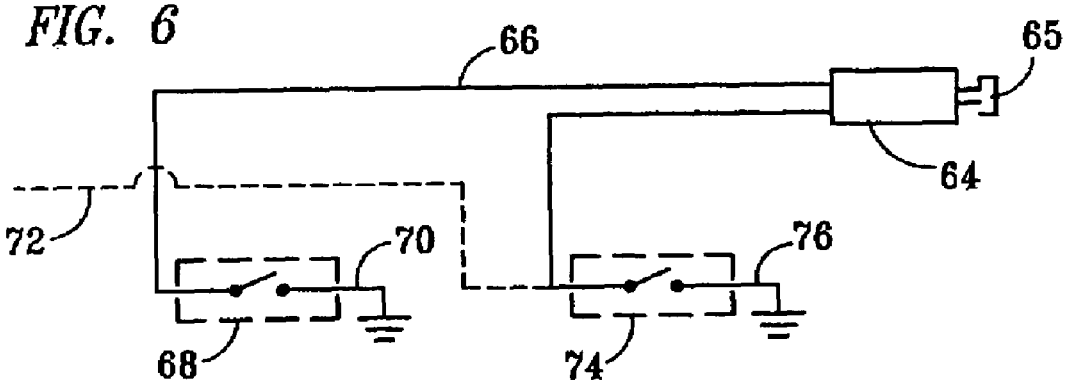
FIG. 6 is a schematic wiring diagram of a positioning system for a garage door opener.

In FIG. 6, a switching arrangement for a garage door opener is shown. Contact switch 64 is shown and comprises a switch that is activated by depressing a member 65, which may close a press-to-close switch. The switch is in electrical contact via a line 66 with a first position switch 68 for a garage door opener (not shown). When closed, switch 64 closes switch 68 to ground via a line 70, thereby directing the garage door opener to a position that is represented by contact of the bottom of the garage door with the top of the ventilated gate.

Alternatively, if switch 64 is not activated, the power supplied through line 72 to the garage door opener is directed to a switch 74, which permits the garage door opener to move the garage door to a position such that the bottom of the garage door is in contact with the cement floor of the garage. A wide variety of switching arrangements can be used to move the garage door to either a closed or partially closed position as desired as well known to the art. For instance, two switches may be wall mounted to permit selection of a desired garage door position.

Figure 7:
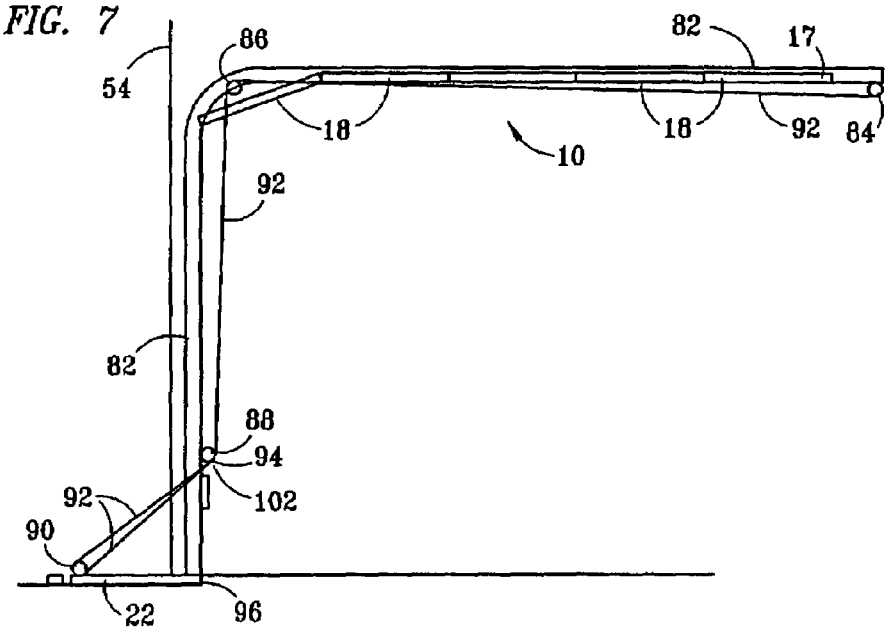
FIG. 7 is a schematic diagram of an open garage door in a garage door support, including the system of the present invention for raising and lowering a ventilated gate by operation of the garage door.

In FIG. 7, an embodiment of the present invention is shown with the ventilation gate in its lowered position. A garage door support 82 is shown as well known to those skilled in the art. The garage door support comprises a track for rollers positioned on the ends of the garage door, which is shown schematically. Only one end of the garage door support is shown since the other end is identical on the opposite side of the door. A first pulley 84 is positioned as shown in a line basically upstream from the direction of flow of the garage door as it is opened. Pulley 84 may be supported from a garage door support, a garage wall, a garage ceiling or the like. A second pulley 86 is positioned near the end of the horizontal portion of the garage door support. This pulley could be positioned at any point near the bent, curved portion of the garage door support. It may also be supported from the garage door support or from a garage wall surface. Desirably, pulley 86 is relatively close to the garage door support 82. This is desirable since it is desired that the cable, which will be discussed hereafter, passing around pulley 86 be relatively near garage door support 82. A third pulley 88 is shown supported near the bottom of the garage door and is positioned to be above the top of ventilated gate 22 when it is in a closed position. This pulley may be supported from the garage wall, the garage door support, the garage floor or the garage door support-mounting members and is desirably near garage door support 82. A fourth pulley 90 is positioned near the top of ventilated gate 22 near its first end as shown in FIG. 7. A cable is then passed from the top of the garage door around first pulley 84 to second pulley 86, which is desirably mounted on the outside of the garage door support, and downwardly to third pulley 88 and around third pulley 88 and to fourth pulley 90 and then back to a fixed member 94, which restrains an end of cable 92. When the garage door is closed, the cable is drawn around pulleys 84, 86, 88 and 90 to raise ventilated gate 22 to its raised position.

It is desirable that pulley 86 and pulley 88 be relatively near garage door support 82 so that the cable is out of the way in the garage space. It is similarly desirable that the cable between pulley 84 and pulley 86 be at an elevation such that it does not constitute a hazard walking under the garage door support and the like. While pulley 86 could be at a variety of locations along the garage door support beyond the end of the horizontal section of the garage door support, it is desirable that it positioned at a sufficient height so that it does not impede walking under the garage door support. Pulley 86 could be positioned on the garage door support or on a wall at approximately the point at which the garage door support becomes vertical. Locations along the curved area or near either end of the curved area are considered to be suitable for the positioning of pulley 88.

Figure 8:
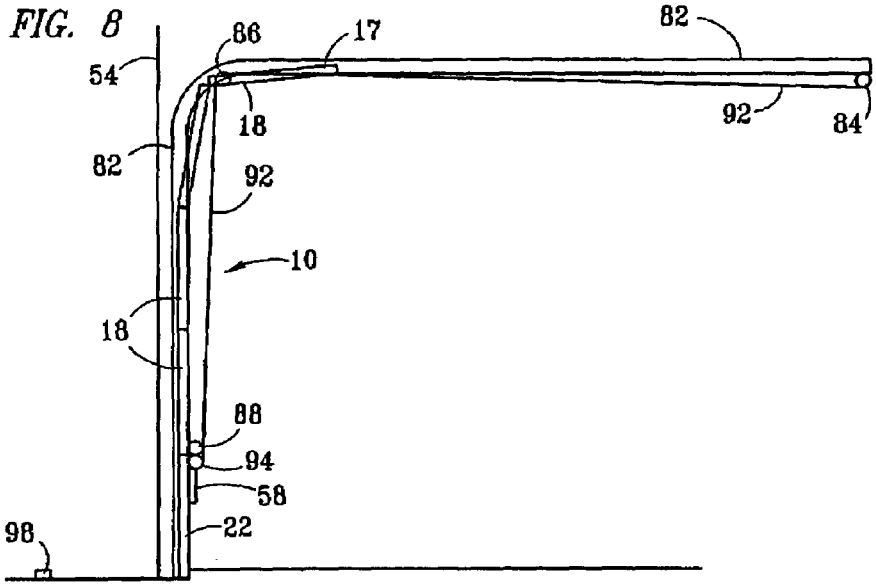
FIG. 8 shows the system of FIG. 7 with the garage door closed and the ventilated gate in a raised position; and, FIG. 9 shows the ventilated gate in a flat position on a driveway surface in front of the garage door.

Positioning the garage door in a partially closed position in contact with the raised ventilated gate in the embodiment shown in FIGS. 7 and 8 can be accomplished by several methods. These methods can include repositioning the single limit switch of the garage door opener to the appropriate new location, using the embodiment shown in FIG. 6 or using the two limit switches as shown in FIG. 6 with a manual switch instead of the contact switch shown in that figure. These methods are well known to those skilled in the art.

The ventilated gate is lowered by a reverse operation of the system whenever the garage door is raised. The garage door opener generates sufficient power to result in returning the ventilated gate to its former position flat on the cement slab in front of the garage door. Similarly, the restraining pin 52 and notch 40 are released so that there is no impediment to the ventilated gate's movement back to its original position. The garage door can be operated manually to automatically raise and lower the gate as the garage door is moved in the garage door support.

Figure 9:
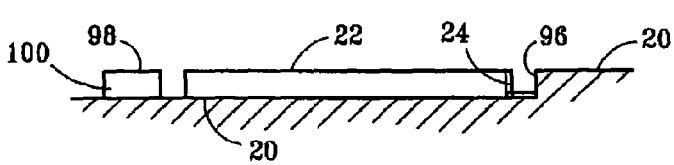

It has been found that it is desirable to position a block 98, such as a 2"×4" wooden member or the like, across the width of ventilated gate 22. Such a block is shown in FIG. 9. The block is fixed to the cement slab and may be beveled as shown at 100 to facilitate the passage of a vehicle tire over the block. This prevents the imposition of horizontal force on ventilated gate 22 and hinges 24 as a vehicle is driven into the garage. Typically a ledge 96 is provided near the point of closure of the garage door and ventilated gate 22 is positioned so that it can open against ledge 96. When the cement slab does not include a ledge, it is desirable to position a block on both sides of the ventilated gate in its lowered position. The bottom of the garage door in its closed position with the automated gate unengaged may rest on a portion of the gate.

In a variation of the present invention, pulley 90 can be eliminated and cable 92 can be connected to the top of ventilated gate 22. The operation of the cable is substantially the same as in FIGS. 7 and 8. This embodiment is less preferred.

With the embodiment shown, the ventilated gate is readily fabricated to be of a top to bottom height equal to that of a section of the garage door. As indicated, this results in the garage door having one section, as shown in FIG. 8, which is not positioned against outer member 14. The width of the ventilated gate is slightly less than the width of the garage door opening defined by inner member 16.

This positioning of the garage door is determined by the height of the particular ventilated gate 22, as shown in the drawings. The ventilated gate shown is approximately 16 feet in width and utilizes at least two hinges. The ventilated gate as shown has a height of 28⅜", but the height may be varied. Clearly, a number of variations can be made to accommodate gates of various heights. The key requirement is that the cable be of a sufficient length so that enough cable is released as the door is raised to permit the ventilated gate to be returned to its flat position. Various techniques can be used to achieve this positioning. Such variations are required whenever the ventilated gate is of different heights as discussed.

In the event that it is desired to remove the ventilated gate from service, the cables may be disconnected and removed from each side of the top of the garage door.

The various switches, pulleys and the like referred to herein are commonly available commercially and will not be discussed further.

Having discussed the present invention by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A lift-up, ventilated gate and a system for opening and closing the ventilated gate for use with a garage door, the system comprising:

a) a garage door comprising a plurality of hingedly joined sections, each of the sections having a first end, a second end, a width and being supported in a garage door support to move the garage door between an open and a closed position;

b) a ventilated gate having a top and a bottom, a frame, a ventilation section in the frame, an inside and an outside, a first end and a second end, being hingedly connectable to a driveway surface across a major portion of the width of the garage door and having a cable connection near the top of the ventilated gate on each of its first and second ends; and, c) a first and a second cable and pulley system adapted for support on at least one of the garage door supports and garage surfaces and connected near the top of the ventilated gate to the first and second ends of the ventilated gate respectively and to a first and a second side respectively of a top of the garage door so that when the garage door is lowered toward its closed position the cable and pulley systems raise the ventilated gate to an upright position so that the top of the ventilated gate engages a bottom of the garage door.

2. The system of claim 1 wherein the ventilated gate is an automatic ventilated gate.

3. The ventilated gate system of claim 1 wherein the garage door is moved in the garage door support by a garage door opener.

4. The ventilated gate system of claim 1 wherein the ventilated gate is constructed of at least one of wood, metal, plastic and combinations thereof.

5. The ventilated gate system of claim 1 wherein the ventilated gate includes at least one receptacle near its top positioned for mating engagement with at least one pin on the garage door and extending downwardly below the bottom of the garage door so that the at least one pin engages the at least one receptacle when the ventilated gate is in an upright position and in engagement with the bottom of the garage door.

6. The ventilated gate of claim 1 wherein the ventilated gate includes at least one pin extending above its top and positioned for mating engagement with at least one receptacle on the bottom of the garage door so that the at least one pin engages the at least one receptacle when the ventilated gate is in an upright position and in engagement with the bottom of the garage door.

7. The system of claim 1 wherein each cable and pulley system comprises a first pulley positioned to engage a cable extending from a connection of the cable to the top of the garage door partially around the first pulley, partially around a second pulley positioned near a curve in the garage door support from a vertical to a horizontal portion and partially around a third pulley positioned near a garage wall supporting the garage door support above the bottom of the garage door in its closed position in engagement with the top of the ventilated gate and partially around a fourth pulley positioned on an upper portion of an inside end of the ventilated gate and then to a fixed connection so that when the garage door is closed the ventilated gate is raised into its upright position to engage the bottom of the garage door.

8. The system of claim 7 wherein the second pulley is supported by the garage door support.

9. The system of claim 1 wherein the system includes a garage door opener and wherein the garage door opener includes a first stopped position with the bottom of the garage door in engagement with the top of the ventilated gate and a second stopped position with the bottom of the garage door in engagement with a floor of the garage.

10. The system of claim 1 wherein the system includes a switch positioned on the ventilated gate in electrical contact with a garage door opener position selector and operative to stop the garage door in a first stopped position when the ventilated gate is in its upright position.

11. The system of claim 1 wherein each cable and pulley system comprises a first pulley positioned to engage a cable extending from a connection of the cable to the top of the garage door partially around the first pulley, partially around a second pulley positioned near a curve in the garage door support from a vertical to a horizontal portion and partially around a third pulley positioned above the bottom of the garage door in its closed position in engagement with the top of the ventilated gate and to a fixed connection to an upper portion of an inside end of the ventilated gate so that when the garage door is closed the ventilated gate is raised into its upright position to engage the bottom of the garage door.

12. The ventilated gate of claim 1 wherein the ventilated gate comprises a plurality of spaced-apart slats, each having a first and a second end and having positioned between each pair of the spaced-apart slats at their ends a block spacer with the block spacers being maintained in position so that the block spacers and end sections of the slats form the top and the bottom portions of the frame with the end slats forming the end portions of the frame.

13. A ventilated gate for use with an overhead garage door comprising a plurality of hingedly joined sections, each of the sections having a first and a second end and being supported in a garage door support at their first and second ends for movement in the garage door support to move the garage door between an open and a closed position, the ventilated gate having a top and a bottom, a frame, a ventilation section in the frame, an inside and an outside, a first and a second end and being hingedly connectable to a driveway surface across a major portion of a width of the garage door opening and being manually raisable to an upright position so that the top of the ventilated gate is positioned for engagement with a bottom of the garage door when the garage door is in a partially closed position, the ventilated gate comprising a plurality of spaced-apart slats, each having a first and a second end and having positioned between each pair of the spaced-apart slats at their ends a block spacer with the block spacers being maintained in position so that the block spacers and end sections of the slats form the top and the bottom portions of the frame with the end slats forming the end portions of the frame.

* * * * *